US005971080A

United States Patent [19]

Loh et al.

[11] Patent Number: 5,971,080

[45] Date of Patent: Oct. 26, 1999

[54] QUICK RESPONSE DRY PIPE SPRINKLER SYSTEM

[75] Inventors: Ralph A. Loh, San Diego, Calif.; James E. Golinveaux, North Wales, Pa.

[73] Assignee: Central Sprinkler Corporation, Lansdale, Pa.

[21] Appl. No.: 08/980,052

[22] Filed: Nov. 26, 1997

[51] Int. Cl.[6] ..... A62C 35/62

[52] U.S. Cl. ..... 169/43; 169/17

[58] Field of Search ..... 169/43, 17, 20, 169/23, 61

[56] References Cited

U.S. PATENT DOCUMENTS

| | | | |
|---|---|---|---|
| 2,352,996 | 7/1944 | Rider | 169/17 |
| 3,401,751 | 9/1968 | Loftin et al. . | |
| 3,595,318 | 7/1971 | Merdinyan | 169/17 |
| 4,570,719 | 2/1986 | Wilk | 169/20 |
| 5,027,905 | 7/1991 | Cousineau et al. | 169/17 |
| 5,099,925 | 3/1992 | Glidden et al. | 169/17 |
| 5,236,049 | 8/1993 | Asselin et al. | 169/61 |
| 5,320,138 | 6/1994 | Ferlitch, Jr. | 137/552.7 |
| 5,720,351 | 2/1998 | Beukema et al. | 169/61 |

*Primary Examiner*—Lesley D. Morris
*Attorney, Agent, or Firm*—Panitch Schwarze Jacobs & Nadel, P.C.

[57] ABSTRACT

A gas charged fluid flow line of a dry pipe sprinkler system is continuously monitored to detect rate of loss of pressure (dp/dt). The rate of pressure loss is used to detect whether there is an open sprinkler head in a sprinkler grid of the system. Detection of an open sprinkler head and opening of a dry valve may occur in a matter of a few seconds, allowing for a quick response to a fire condition and accurate discrimination of a pressurized gas leak condition. The system may operate at charge pressures in the range of about 7 psig to about 15 psig.

23 Claims, 14 Drawing Sheets

QUICK RESPONSE DRY PIPE SPRINKLER SYSTEM

BACKGROUND OF THE INVENTION

The present invention relates generally to a dry pipe sprinkler system and, more particularly, to such a system which operates using low pressure gas charged fluid flow lines and which includes circuitry for rapidly detecting an open sprinkler head condition and for discriminating such a condition from a pressurized gas leak in the charged dry pipe.

Dry pipe sprinkler systems are well-known in the prior art. A dry pipe sprinkler system includes a dry pipe sprinkler grid containing a plurality of normally closed sprinkler heads. The dry pipe sprinkler grid is connected via fluid flow lines to a dry pipe valve or primary water supply valve which has a dry output side facing the fluid flow lines and a wet input side facing a pressurized source of service water. In operation, the fluid flow lines and sprinkler grid fluid flow lines are filled or charged with a pressurized gas, such as air. Current industrial dry pipe systems generally charge the fluid flow lines to about 35 to 40 psig. The sprinkler heads typically include normally closed temperature-responsive valves. If heated sufficiently, the normally closed valve of the sprinkler head opens, thereby allowing the pressurized air to escape from the fluid flow lines. When the air pressure in the fluid flow lines drops below a predetermined value, a mechanism causes the primary water supply valve to open, thereby allowing the service water to flow into the fluid flow lines of the dry pipe sprinkler grid (displacing the air therein), and through the open sprinkler head to extinguish the fire or smoke source, or to minimize any damage therefrom. Water flows through the system and out the open sprinkler head (and any other sprinkler heads that subsequently open), until the sprinkler head closes itself, if automatically resetting, or until the water supply is turned off.

A dry pipe sprinkler system is distinguished from a wet pipe sprinkler system. In a wet pipe sprinkler system, the fluid flow lines are prefilled with water, and water is retained in the sprinkler grid by the valves in the sprinkler heads. As soon as a sprinkler head opens, the water in the sprinkler grid immediately flows out of the sprinkler head. In a wet pipe sprinkler system, the primary water valve is the main shut-off valve, which is in the normally open state.

There are a large number of different mechanisms and techniques for causing a dry pipe sprinkler system to go "wet" (i.e., to cause the primary water supply valve to open and allow the water to fill the fluid flow supply lines). In one known technique, after a sprinkler head opens, the pressure difference between the air pressure in the fluid flow lines and the water supply pressure on the wet side of the primary water supply valve must reach a specific hydraulic unbalance before the primary water supply can open. It may take up to 30 seconds to reach this state, depending upon the volume of the entire system. If the system is large and/or if the system is charged to a typical pressure such as 40 psig, a considerable volume of air must escape or be expelled from the open sprinkler head before the specific hydraulic unbalance is reached to open the primary water valve and then to force water through the grid through the remaining pressurized gas, to finally discharge through the open sprinkler.

Dry pipe sprinkler systems suffer from other problems. They are susceptible to false alarms from ambient temperature-induced expansion and contraction of the pressurized air in the fluid flow lines and from gas leaks in the fluid flow lines. For example, the pressurized gas may contract to a degree that triggers opening of the primary water valve. The system must then be drained and recharged.

There is significant interest in installing sprinkler systems in residential units for protection of residents and property. Wet pipe systems are not well-suited to residential use. Builders desire to hide the fluid flow lines and may pass them through unheated or poorly heated areas where they are susceptible to freezing and bursting in cold weather. Furthermore, there is a reluctance to install dry pipe sprinkler systems in residential environments because of the deficiencies discussed above, namely the relatively slow response time of the systems, and the problems associated with false alarms. Also, existing dry pipe systems are expensive to install and maintain due, in part, to the necessity to maintain a high pressure gas charged system.

Accordingly, there is a need for a dry pipe sprinkler system which has a quick response time, which is capable of accurately discriminating between false alarm conditions, an open sprinkler condition and a pressurized gas leak condition, and which can be operated at a reduced fluid flow line pressure level. The present invention fulfills such needs.

BRIEF SUMMARY OF THE INVENTION

The present invention provides methods and apparatus for operating a dry pipe sprinkler system to detect pressurized gas leaks in a gas charged fluid flow line and sprinkler openings in the system.

One embodiment of the invention provides a method of operating a dry pipe sprinkler system. The method comprises monitoring the charged fluid flow line by sensing pressure in a gas charged fluid flow line of the system and generating a signal representing instantaneous gas pressure in the fluid flow line, calculating a rate of change of the instantaneous gas pressure, comparing the rate of change to a predetermined negative rate of change value, and outputting an open sprinkler head signal if the rate of change is more negative than the predetermined negative value, thereby detecting sprinkler openings in the system.

Another embodiment of the invention provides apparatus including electronic circuitry adapted for use in a dry pipe sprinkler system to monitor a gas charged fluid flow line in the system. The electronic circuitry comprising an input for receiving an electrical signal representing the instantaneous gas pressure in the gas charged fluid flow line, and a processor. The processor uses the electrical signal to calculate a rate of change of the instantaneous gas pressure and compare the rate of change to a predetermined negative rate of change value. The processor outputs an open sprinkler head signal if the rate of change is more negative than the predetermined negative value.

Another embodiment of the invention provides a method of controlling the state of a primary fluid flow supply valve associated with a dry pipe sprinkler system. The method comprises detecting the occurrence of an open sprinkler in the system by monitoring a rate of change of gas pressure in the fluid flow line and determining when the rate of change is more negative than a predetermined negative value, and opening the primary fluid flow supply valve to allow fire retarding fluid to flow through the fluid flow line when the rate of change is determined to be more negative than the predetermined negative value.

Another embodiment of the invention provides a method of monitoring a dry pipe sprinkler system to detect pressurized gas leaks in a gas charged fluid flow line in the system wherein the fluid flow line has an operating pressure. The method comprises sensing pressure in a gas charged fluid flow line of the system, comparing the sensed pressure to a preset value which is less than the operating pressure, recharging the fluid flow line to the operating pressure if the sensed pressure is below the preset value by operating a gas compressor which has its output connected to the fluid flow line, and outputting a pressurized gas leak signal if the fluid flow line pressure is not restored to the operating pressure within a predetermined time period.

Another embodiment of the invention provides a method of monitoring a dry pipe sprinkler system to detect pressurized gas leaks in a gas charged fluid flow line in the system, wherein the fluid flow line has an operating pressure. The method comprises sensing pressure in a gas charged fluid flow line of the system, comparing the sensed pressure to a preset value which is less than the operating pressure, recharging the fluid flow line to the operating pressure if the sensed pressure is below the preset value by operating a gas compressor which has its output connected to the fluid flow line, and outputting a pressurized gas leak signal if the gas compressor is actuated to restore pressure more than a predetermined number of times in a fixed time period.

Another embodiment of the invention provides a method of monitoring a dry pipe sprinkler system to detect pressurized gas leaks in a gas charged fluid flow line in the system. The method comprises sensing pressure in a gas charged fluid flow line of the system and generating a signal representing instantaneous gas pressure in the fluid flow line, calculating a rate of change of the instantaneous gas pressure, comparing the rate of change to a predetermined negative rate of change value, and outputting a pressurized gas leak signal if the rate of change is negative and less negative than the predetermined negative value.

BRIEF DESCRIPTION OF THE DRAWINGS

The following detailed description of preferred embodiments of the invention will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
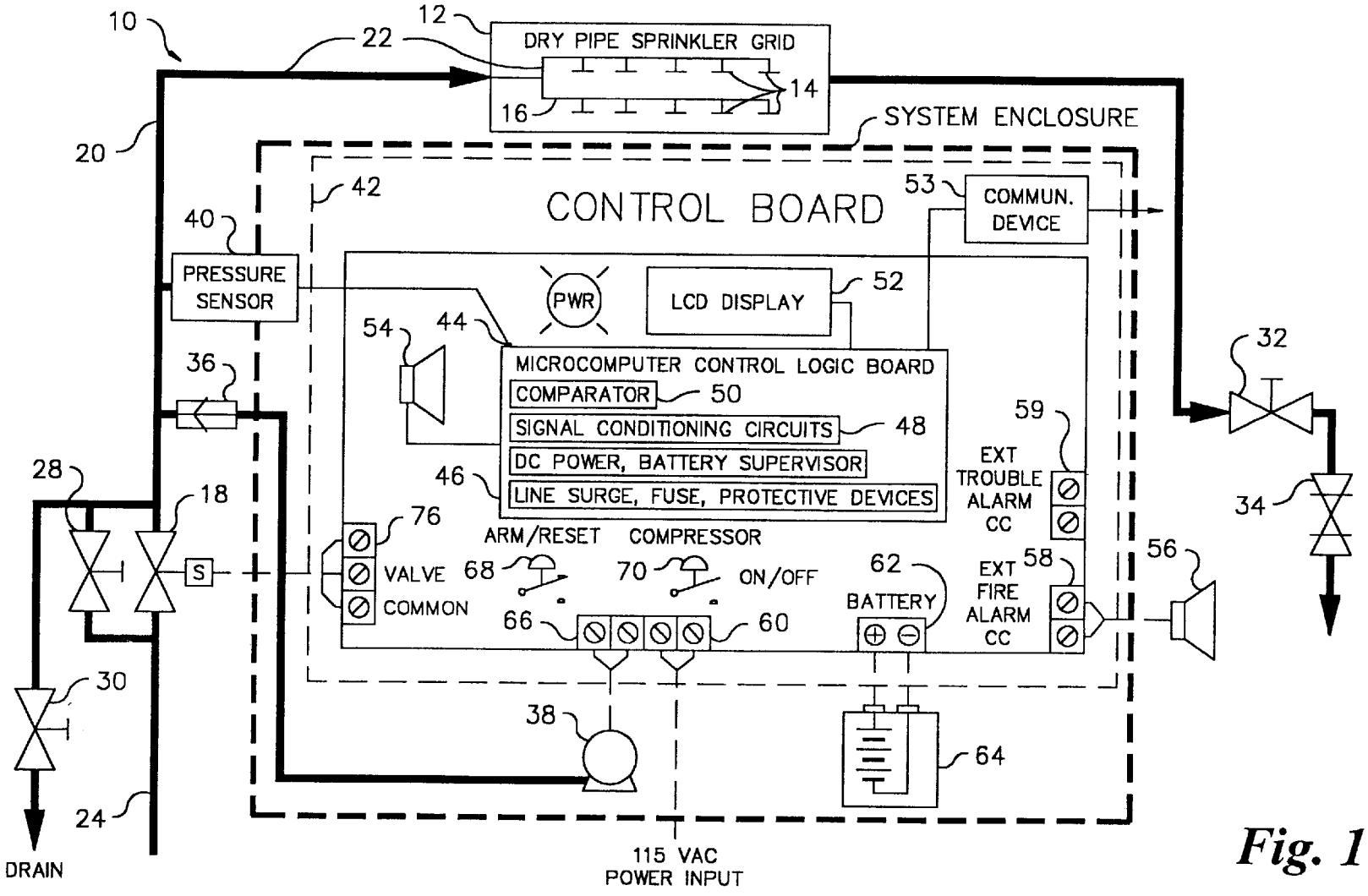
FIG. 1 is schematic block diagram of a dry pipe sprinkler system in accordance with a preferred embodiment of the present invention.

Certain terminology is used herein for convenience only and is not be taken as a limitation on the present invention. In the drawings, the same reference numerals are employed for designating the same elements throughout the several figures.

The present invention is based on the discovery that by monitoring the rate of pressure drop in a gas charged fluid flow line of a dry pipe sprinkler system, it is possible to quickly and accurately discriminate between, and determine when, there is an open sprinkler head and when there is a slow leak in the system. In the present invention, the fluid flow line may be charged to pressures as low as about 7 to about 15 psig, although the invention works equally well with higher charge pressures. The time between detection of an open sprinkler head to opening of the primary water supply valve is about two seconds or less, compared to prior art response times which may be up to about 30 seconds. Furthermore, it takes less time than in the prior art for the water to reach the open sprinkler head because there is less air to expel from the fluid flow line due to the lower charge pressure.

The monitoring and control parts of the present invention may be retrofitted to existing dry pipe sprinkler systems, or may be built into newly installed systems.

FIG. 1 shows a dry pipe sprinkler system 10 in accordance with a preferred embodiment of the present invention. The system 10 includes a dry pipe sprinkler grid 12 having a plurality of normally closed sprinkler heads 14 connected together by fluid flow lines 16, a solenoid-driven dry valve (hereafter, "primary water supply valve 18") having a normally wet input side and a normally dry output side, and at least one fluid flow supply line 20 for providing a fluid connection between the dry pipe sprinkler grid 12 and the output side of the primary water supply valve 18. In operation, the supply line 20 is charged with pressurized gas, preferably air. The fluid flow lines 16 are in fluid connection with the supply line 20 and contain pressurized gas (e.g., air). The lines 16 and 20 may thus collectively be referred to as a "charged fluid flow line" of the system 10, labeled collectively as 22. The wet side of the primary water supply valve 18 is in fluid connection with a vertical water pipe or riser 24 containing water under pressure, such as a one inch diameter riser. The system 10 further includes an emergency override valve 28, which may be a ball valve, in fluid connection at one end to the fluid flow line 22, and in fluid connection at the other end to the wet side of the primary water supply valve 18.

A drain cock or drain valve 30 in fluid connection at one end to the dry side of the primary water supply valve, and at the other end to an open drain, provides a means to drain the fluid flow line 22 if it becomes filled with water. Together, the emergency override valve 28 and the drain valve 30 are used to drain the fluid flow line 22 if it becomes filled with water but can also be used to manually bypass the valve 18. The fluid flow lines 16 of the dry pipe sprinkler grid 12 are also in fluid connection with an inspector test valve 32 and related orifice 34. Furthermore, the fluid flow line 20 is in fluid connection, through a check valve 36, with an air compressor 38. In one embodiment of the invention, the check valve 36 may have a ¼ inch NPT connection. The air compressor 38 is used to initially charge the fluid flow line 22 and to recharge the fluid flow line 22 to a desired pressure when necessary.

The parts of the system 10 described above are conventional and thus are not described in further detail. However, the primary water supply valve 18 includes a special solenoid (labeled as S in FIG. 1), as described in more detail below. While the system 10 is charged with air pressure and delivers water to the sprinkler grid 12, the scope of the invention includes systems which are charged with other types of gas, and which may deliver fire retarding fluids other than water (e.g., foam, HALON 1211®) to the sprinkler grid 12. In such a system, the air compressor 38 would be replaced by a suitable gas compressor.

To reduce response time and false alarms in the system 10, a pressure sensor 40 and electronic circuitry 42 are connected to the system 10 to monitor and control system operation. The input of the pressure sensor 40 is in fluid communication with the fluid flow line 20 and may have a ⅛ inch NPT connection. The pressure sensor 40 has an electrical signal output which is connected to the electronic circuitry 42 by any suitable communication medium, such as ribbon cable. The pressure sensor 40 outputs an electrical signal which is related in a predefined manner to, and thus represents, the instantaneous air pressure sensed by the sensor 40 in the fluid flow line 20. One suitable pressure sensor has the following approximate parameters:

| | |
|---|---|
| Measurement Range: | 0 to 50 psig, set to 20.5 psig Full Scale |
| Measurements: | 2 readings per second, minimum |
| Resolution: | 0.01 psig (12 binary bits) |
| Accuracy: | ±2% full scale, over system temperature range, including linearity and hysteresis |
| Output Leads: | 4 |

The electronic circuitry 42 includes an input terminal 44 for receiving the output electrical signal from the pressure transducer 40. The electronic circuitry 42 receives analog output electrical signals from the pressure transducer 40, digitizes the signals, and uses the digitized signals to perform at least the following functions:

(1) Calculate the rate of change of the instantaneous air pressure, dp/dt.

(2) Compare the rate of change to a predetermined negative rate of change value.

(3) Output a signal that operates solenoid S of the primary water supply valve 18 if the rate of change is more negative than (i.e, less than) the predetermined negative rate of change value. This signal also becomes an "open sprinkler head signal" which is used to indicate a fire alarm condition, as well as to provide local audio and/or visual indicators of the open sprinkler/open valve 18 condition.

(4) Determine if the line pressure has dropped below a preset value, and if so, actuate the air compressor 38 until the line pressure is restored to the normally charged value.

(5) Determine from the operation of the air compressor 38 if there is a pressurized air leak in the charged fluid flow line, and, if so, output a slow air leak signal and output appropriate local and remote indicators and alarms. In one alternative embodiment of the invention, dp/dt may be used to determine if there is a pressurized air leak.

An open sprinkler head condition causes the following outputs to occur (1) a continuous series of beeps from the audible alarm, (2) a single pulse which operates the solenoid S of the primary water supply valve 18, (3) a flashing coded indication of a fire alarm, FFFF on the LCD display, and (4) a contact closure to signal an external device, such as a wall mounted fire alarm or a communication device. A pressurized air leak causes an output in the form of beeps of an audible alarm and a flashing coded indication of low air on an LCD display. These features are described in more detail below.

To perform such functions, the electronic circuitry 42 uses any suitable hardware and/or software. In FIG. 1, the functions are implemented in a microcomputer control logic board 46 having processor elements including signal conditioning circuits 48 and a comparator 50. The electronic circuitry 42 also includes a display 52, such as an LCD display, for displaying the status of the system 10, and alarm conditions. Status/alarm conditions may be indicated as follows:

| Status/Alarm Condition | LCD four digit code display |
|---|---|
| Sprinkler has opened | FFFF |
| Pressurized air leak detected | F 1 |
| Primary water supply valve 18 leaking | F 2 |
| Time to change the battery 64 | F 3 |
| AC Power off | F 4 |

The display 52 may be programmed to output the instantaneous fluid flow line pressure when not displaying alarm/status conditions. The local display 52 may be replaced or supplemented with a communication device 53, such as a wired or wireless phone or modem, for sending alarm condition signals to a remote location. An internal audible alarm 54 may also be provided to supplement and/or replace the display 52. The audible alarm may provide the following alarms:

| | |
|---|---|
| FIRE ALARM: | Loud, constant tone, similar to a residential smoke detector. |
| TROUBLE ALARM: | Periodic beeps, such as two short beeps every minute. |

The fire alarm indicates an open sprinkler head condition. The trouble alarm indicates one or more of the remaining conditions of a slow air leak, high air pressure, low battery and AC Power Off.

An external audible alarm 56 connected to output terminals 58 may also be provided which will be triggered by continuous contact closure of an alarm switch (not shown), for example, a Form A continuous contact closure operating at 5A, 24VDC, 115VAC. Likewise, an external trouble alarm (not shown) may be connected to output terminals 59 which will be triggered by continuous contact closure of a trouble switch (not shown) of a similar nature as the alarm switch.

The electronic circuitry 42 further includes input terminals 60 for providing AC power to the circuitry 42 via an on-board integral power supply (not shown), and input terminals 62 for connecting fail-safe DC battery backup power to the circuitry 42 from a battery 64. The AC power is also used to maintain a full-charge on the battery 64. Suitable AC and DC voltage and power parameters are as follows:

| | |
|---|---|
| AC Voltage: | 115 VAC Nominal at 60 Hz (95 to 130 VAC range) |
| System Power | 20 W max when pressurizing, 1 W nominal |
| DC Battery Backup Power: | 12 V Battery with sufficient reserve to supply power for about 30 days |

As previously discussed, it is known to provide an air compressor as part of a dry pipe sprinkler system. In the present invention, the air compressor 38 is connected to output terminals 66 of the electronic circuitry 42 so that the air compressor 38 can be precisely controlled based upon information obtained from the signal conditioning circuits 48 and the comparator 50, as discussed in more detail below.

Referring again to the DC battery backup, if a 12 V battery is used for the backup, there should preferably be sufficient reserve power to operate the electronic circuitry 42 for about 30 days. In the preferred embodiment which uses the 12 V battery, air pressure is not controlled during an AC power outage. That is, the air compressor 38 is not operable in the battery backup mode. If it is desired to provide air pressure control during an AC power outage, the capacity of the battery 64 must be increased and extra circuitry must be added, such as an inverter, to allow the air compressor to operate from the back-up power.

The electronic circuitry 42 further includes pushbutton switch 68 for arming/resetting the system 10 and switch 70 for manually turning the air compressor 38 on and off. "Arming" the system refers to placing it in the fire detection active mode. "Resetting" refers to closing the primary water supply valve 18 and placing the system in a standby mode, non-active, fire detection mode.

Furthermore, the electronic circuitry 42 includes output terminal 76 for sending control signals to open or close the primary water supply valve 18. The solenoid S of the primary water supply valve 18 is designed to latch open by a short duration pulse of less than 100 milliseconds. By using a fast response solenoid, there is no requirement for a large DC current holding value for activating the valve coil.

As noted above, the computing aspects of the electronic circuitry 42 uses any suitable hardware or software to perform the functions described herein. For example, the signal conditioning circuits 48 and comparator 50 may be implemented using computer-related hardware, such as a microprocessor, or such circuits could be implemented using discrete electronic components. Such hardware and software, such as microprocessor chips, memory devices and the like, are well-known and thus not described in detail. If the electronic circuitry 42 includes a microprocessor, a watchdog timer and alarm is provided to detect failure of the microprocessor.

Figure 2A:
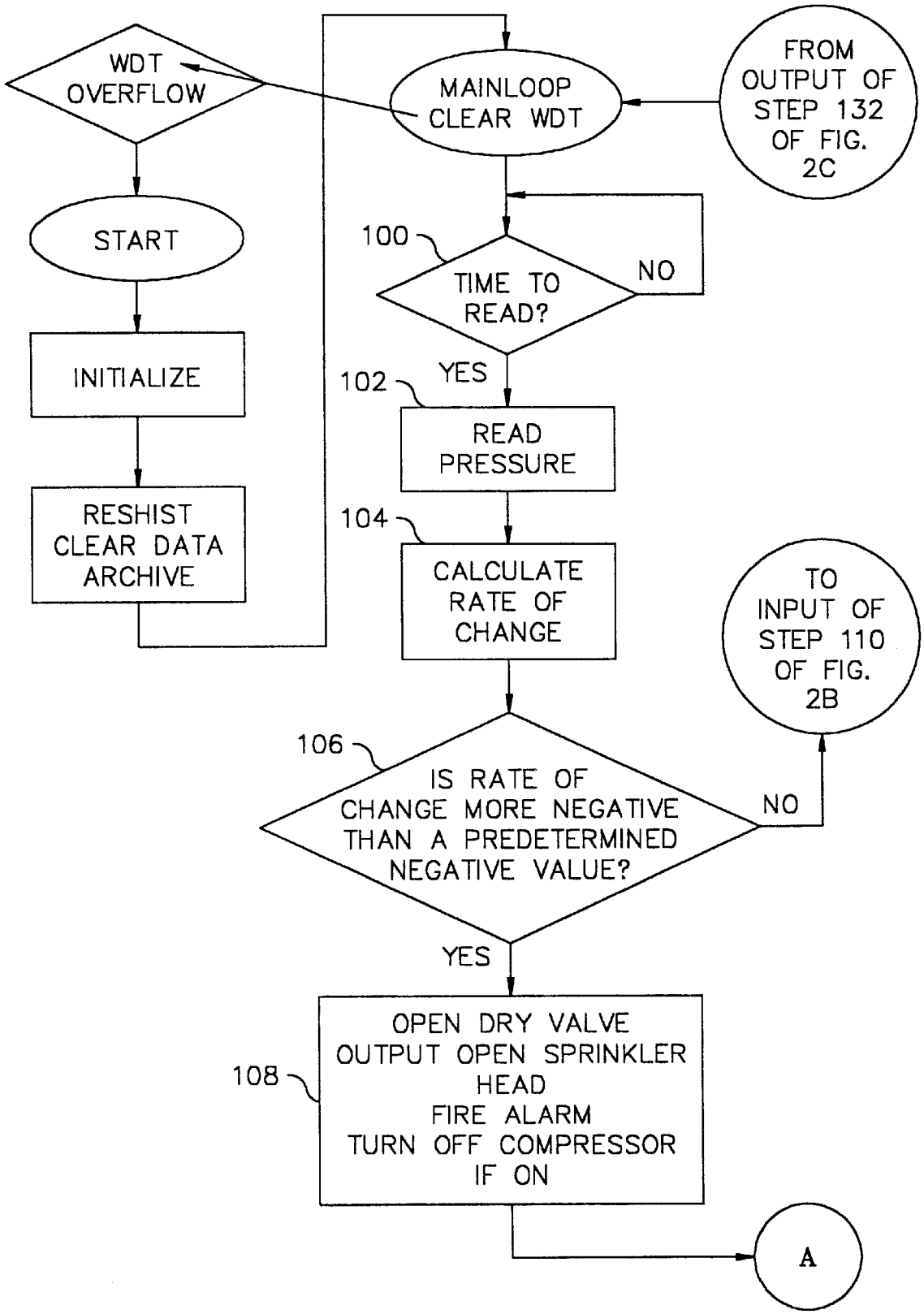
FIGS. 2A, 2B and 2C taken together, is a general flowchart of the steps for performing the present invention.
Figure 2B:
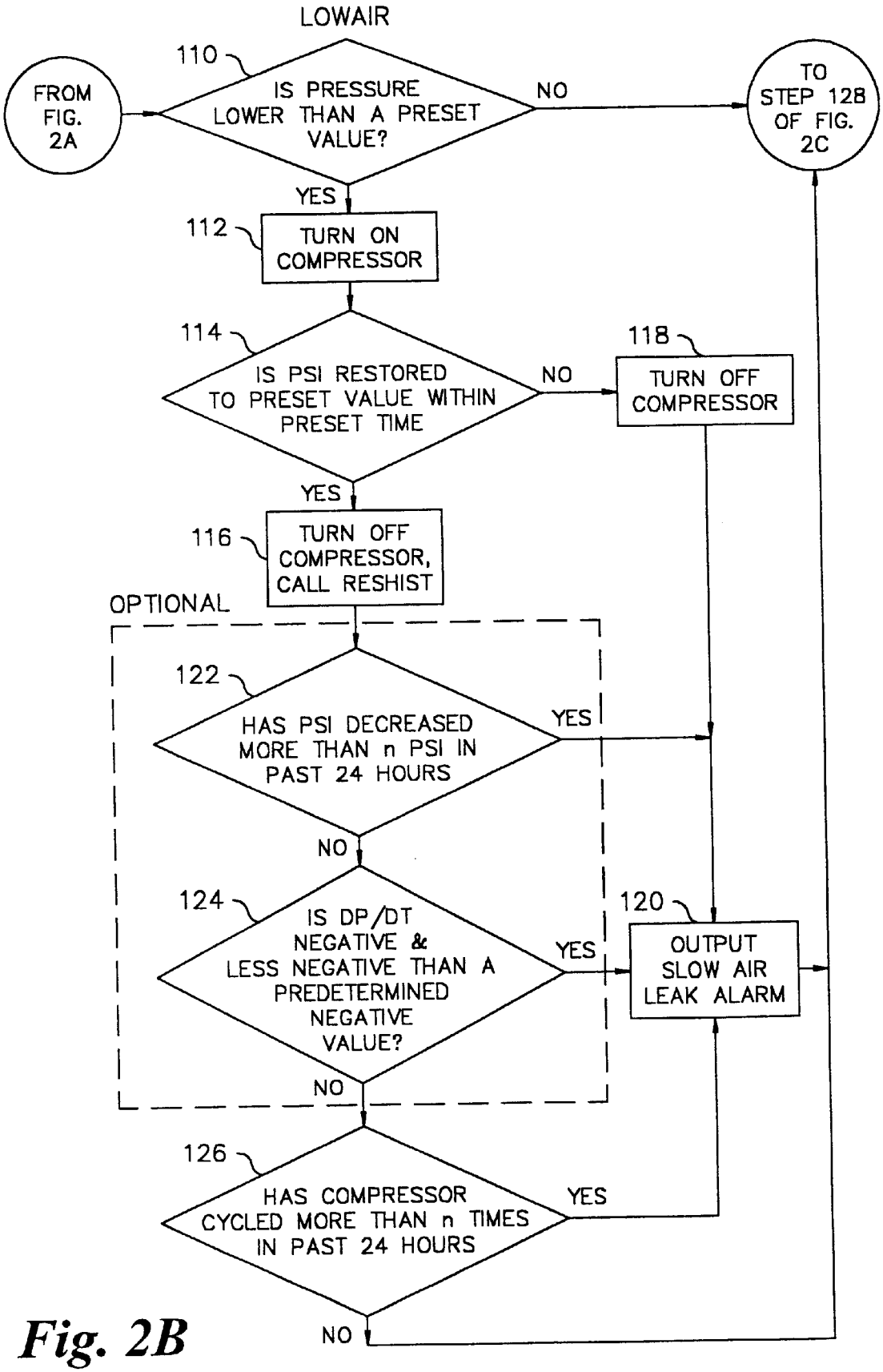
Figure 2C:
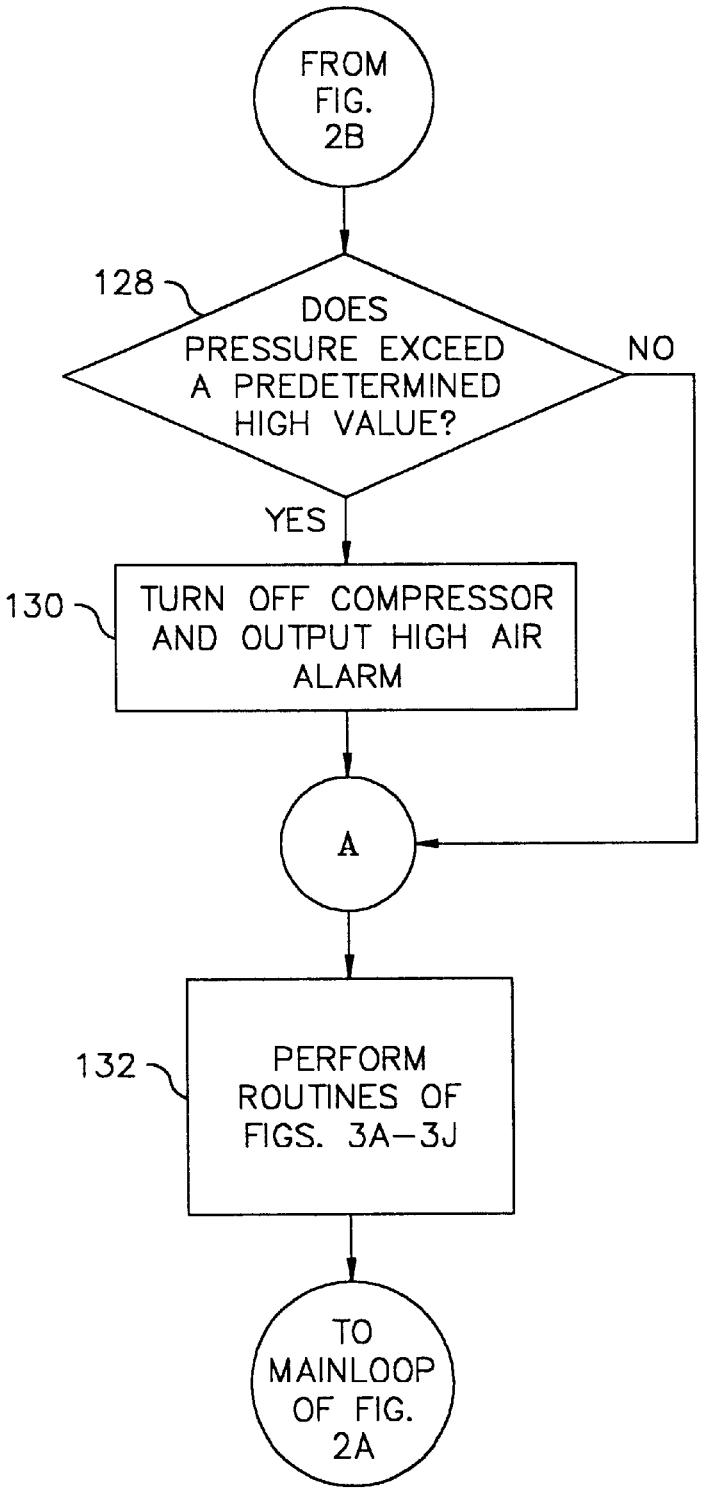

The watchdog timer resets the microprocessor and re-arms the system if a glitch or disturbance sets the microprocessor program counter to an unreturnable location which is not in a flow loop (FIGS. 2A–2C). When power is restored, system logic is reset at a beginning of the loop.

Having described the system environment and hardware aspects of the present invention, FIGS. 2A–2C, taken together, show a general flowchart of the steps for monitoring and controlling the system 10 in accordance with one preferred embodiment of the present invention. As discussed above, the steps of the flowchart may be performed in any appropriate combination of hardware and software.

Referring to FIGS. 1 and 2A–2C, the fluid flow lines 22 are initially charged either with an external air source (not shown) or by the air compressor 38. Pushbutton switch 70 allows the operator to manually turn on the compressor 38, after which it stops automatically when a preset operating pressure (e.g. 14 psig) is reached. Alternatively, the operator can arm the system using pushbutton switch 68, after which the compressor will automatically turn on if the pressure is less than a preset minimum pressure (e.g. 9 psig.) and will turn off when the pressure reaches the preset operating pressure.

After the compressor 38 turns off, the system 10 is given a short time to stabilize (YES output of step 100).

After stabilization, clearing of a watchdog timer overflow, and completion of initialization steps, instantaneous fluid flow line pressure measurements are periodically taken using the pressure sensor 40 (step 102). For example, five measurements may be taken every second. The present pressure reading and one or more immediately preceding readings are collected, the previous reading(s) having been stored in a memory. Next, an instantaneous pressure rate of change, dp/dt, is calculated using an algorithm (step 104). The number of previous readings which are used to calculate the rate of change depends upon the particular algorithm used. The algorithm may discard values which are determined to be out of range based on adjacent readings. The measured rate of change is then compared to a predetermined negative value (step 106).

If the measured rate of change is more negative than the predetermined negative value, the output of the decision block in step 106 is YES, and signals are generated to open the primary water supply valve (dry valve) 18, to output an open sprinkler head fire alarm (step 108) and to turn off the compressor 38 if it is on. Step 106 is performed in the comparator 50. After step 108 is performed, the process continues with the routines of FIGS. 3A–3J.

If the measured rate of change is less negative than the predetermined negative value, the output of the decision block in step 106 is NO and the process continues to step 110.

To illustrate step 106 in more detail, consider an example wherein the predetermined negative rate of change value is −0.2 psig/second for a fluid flow line normally charged to 12 psig. If the measured rate of change value is −0.4, the output of the decision block in step 106 is YES because −0.4 is more negative than −0.2. If the measured rate of change value is −0.1 or 0.0 or +0.1, the output of the decision block in step 106 is NO because these values are all less negative than −0.2.

Next, the current pressure in the fluid flow line 22 is checked to determine if it lower than a preset value (step 110), and if so, the air compressor 38 is actuated to restore the pressure to the normally charged value (step 112). For example, if the system is normally charged to 12 psig, the predesired value may be set to 10. Thus, if the measured pressure is below 10 psig, the output of the decision block in step 110 is YES, whereas if the measured pressure is 10 psig or higher, the output of the decision block is NO. If the output from step 110 is NO, the process continues with step 128.

To further explain step 110, the output of the decision block will be NO if the primary water supply valve has opened because the pressure of the incoming water will cause the pressure in the fluid flow line 22 to exceed the normal gas charged level. The output will also be NO if the primary water supply valve 18 is closed (i.e., no open sprinkler heads) and if no air has leaked out of the fluid flow line 22, such as when dp/dt is zero over the entire measurement period. Furthermore, the output will also be NO if the primary water supply valve 18 is closed and there is a slow air leak in the fluid flow line 22, provided that the pressure in the line 22 has not dropped below the preset value. However, the output of the decision block will be YES if the primary water supply valve 18 is closed and there is a slow air leak in the fluid flow line 22 which has, over time, caused the pressure in the line to decrease from the normally charged value to a value below the preset value. For example, consider a slow air leak resulting in a constant pressure drop of 0.01 psi/hour (0.24 psi/day), and a line 22 normally charged to 12 psi which has a triggering preset value of 10 psi. Approximately nine days after such a leak begins, the line pressure will drop below 10 psi, thereby causing the output from the decision block of step 110 to change from NO to YES.

If the output of step 110 is YES, the air compressor 38 is actuated to restore the pressure to the desired value (step 112). The line pressure is continuously monitored during the pressure recharging. Next, the system determines if the pressure is restored to the normally charged value within a predetermined time period (step 114), such as 25 minutes. If so, the air compressor 38 is turned off and routine "RESHIST" is called (step 116). The routine "RESHIST", also shown in FIGS. 3A, 3C and 3F, clears historical data and provides a delay before making comparisons for dp/dt changes. The process continues with optional steps 122, 124 or step 126. If the pressure has not been restored after a predetermined time period (i.e., if the air compressor 38 is still running after the predetermined time period), the air compressor 38 is turned off (step 118) and a slow air leak alarm is output (step 120).

After the air compressor 38 is turned off in step 116, the system optionally determines if more than n psi of air pressure has leaked from the system in the past twenty-four hours (step 122). If so, a slow air leak alarm is output (step 120). Otherwise, an optional determination is made as to whether the current rate of change in line pressure is negative and less negative than a predetermined negative value (step 124). This step is similar to step 106, except that the system checks for small negative values. In the example above, a value of −0.1 would cause a YES output in step 106 because −0.1 is less negative than the predetermined negative value of −0.2.

If the output from step 124 is NO, the system determines if the air compressor 38 has cycled on and off more than n times in the past day (step 126). If so, a slow air leak alarm is output (step 120). Otherwise, the process continues with step 128.

To review steps 114–126, a slow air leak determination is made as a result of one or more of the following conditions:

(1) Failure to repressurize the line within a predetermined time period. This condition requires immediate attention because it indicates that the air compressor 38 may have insufficient capacity to maintain pressure in the line, even if left to run continuously. Without sufficient pressure in the line, the system might be unable to perform the critical step 106 of detecting an open sprinkler condition.

To illustrate condition (1), consider a small air compressor 38 which outputs 0.1 psi/minute. Such a compressor can output 2.5 psi in 25 minutes. Thus, if the line pressure drops below 10 psi, the air compressor 38 should be able to restore the pressure to 12 psi in less than 25 minutes, assuming there are no air leaks. However, if there is an air leak of 0.05 psi/minute, the line pressure after 25 minutes will be reduced by 1.25 psi as a result of the air leak. The line pressure after 25 minutes will thus be 11.25 psi (10+2.5 from air compressor −1.25 from slow air leak), thereby triggering a NO output from the decision block in step 114. In the case of a larger leak or a smaller capacity air compressor, the pressure loss from the air leak may even exceed the repressurizing capacity of the air compressor.

(2) Detection of frequent cycling of the air compressor to maintain the normally charged line pressure. This condition also indicates the presence of the slow leak, but the capacity of the air compressor 38 is sufficiently large and the air leak is sufficiently small so that the air compressor 38 can restore pressure within the predetermined time period. Condition (2) is more likely to indicate the presence of a very slow leak, compared to condition (1) which likely indicates a larger slow leak.

(3) Detection that more than n psi has leaked from the system over a twenty-four hour time period.

(4) Detection that there is a slow pressure loss caused by a slow air leak by directly monitoring dp/dt. A high resolution pressure monitor must be used to accurately monitor this condition. If dp/dt is used to detect slow air leaks, very small negative dp/dt values should be ignored if they are the result of a pressure loss from a drop in the ambient temperature.

The conditions (1)–(4) may be monitored simultaneously to provide redundancy for detecting slow leaks. Alternatively, only one of the four conditions may be monitored. Redundancy is preferred. In one preferred embodiment of the invention useful for a residential installation, conditions (1) and (2) are monitored. In another preferred embodiment of the invention useful for a commercial installation, condition (3) is monitored, and conditions (1) and/or (2) may optionally be used for redundancy. If an installation does not use a permanently mounted compressor, conditions (3) and/or (4) would be monitored. If an installation uses an air compressor 38 which has a large capacity and which can quickly recharge the pressure even when a significant slow leak exists, it will not be feasible to monitor condition (1) because it will rarely, if ever, occur. In such an installation, conditions (1), (2) and/or (3) would be monitored.

To further explain the terminology used above, a significant or large slow leak is a slow leak which causes a steady loss in the line pressure, but which does not have a dp/dt which is sufficiently negative to indicate an open sprinkler head condition.

After steps 114–126 are performed, the line pressure is checked to determine if it exceeds a predetermined high value, such as 14 psi in a system normally charged to 12 psi (step 128). If so, a signal is sent to turn off the air compressor 38 and a high air alarm is output (step 130). There are at least three reasons why the line pressure might exceed the normally charged level. First, the primary water supply valve 18 may be leaking so that water enters the line 22. Since there is no outlet for the water leaking into the line 22, the pressure in the line 22 slowly increases. Second, the line 22 may have been accidentally overfilled during manual charging. Third, the air compressor 38 may be broken and stuck in the ON position. While the air compressor 38 should be in the OFF position just prior to step 128, a signal is sent to the air compressor 38 to ensure that it is off, or to try to shut it off, if previous attempts in steps 116 and 118 were unsuccessful.

Figure 3A:
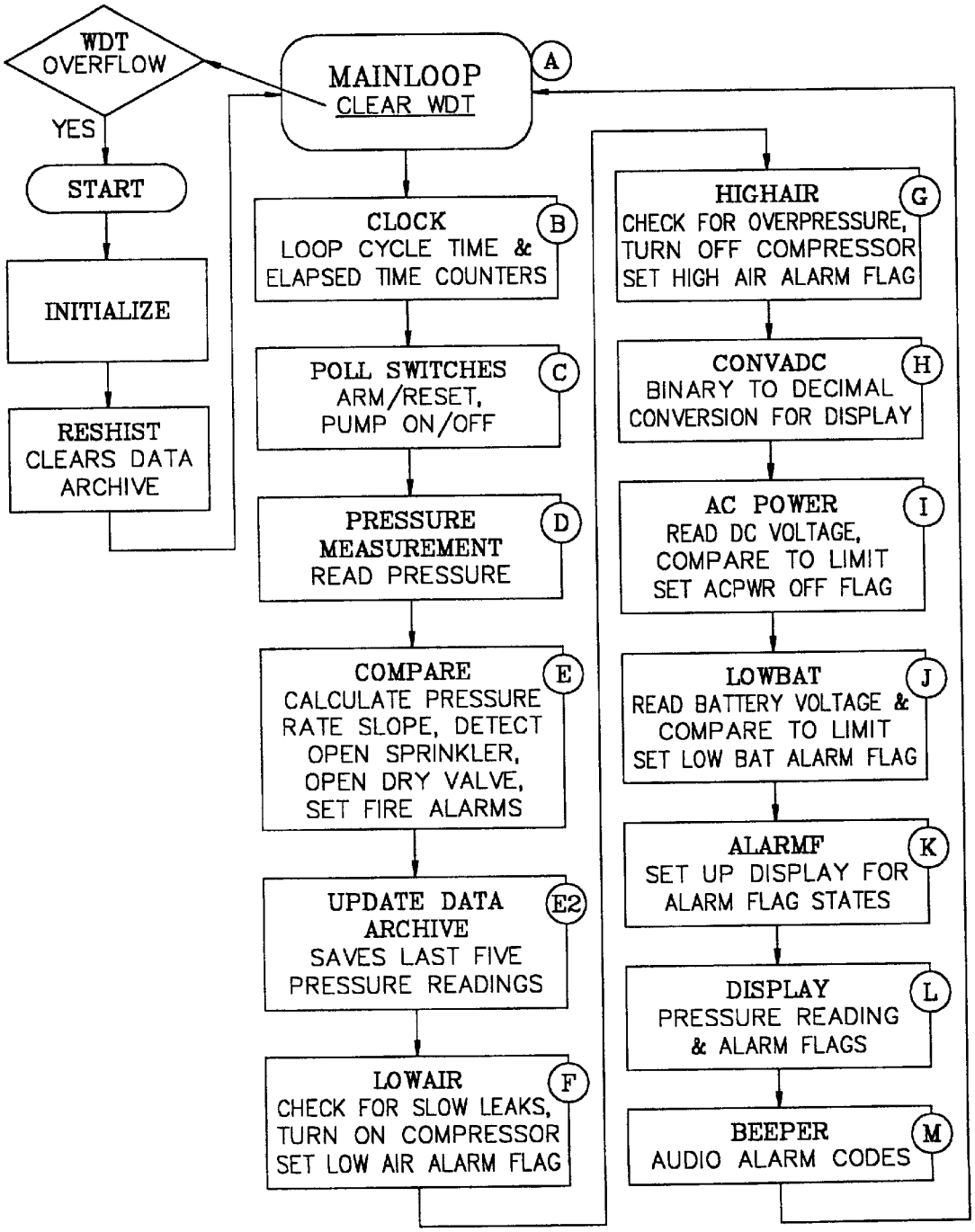
FIGS. 3A–3J, taken together, is a detailed flowchart of the steps for performing one preferred embodiment of the present invention.
Figure 3B:
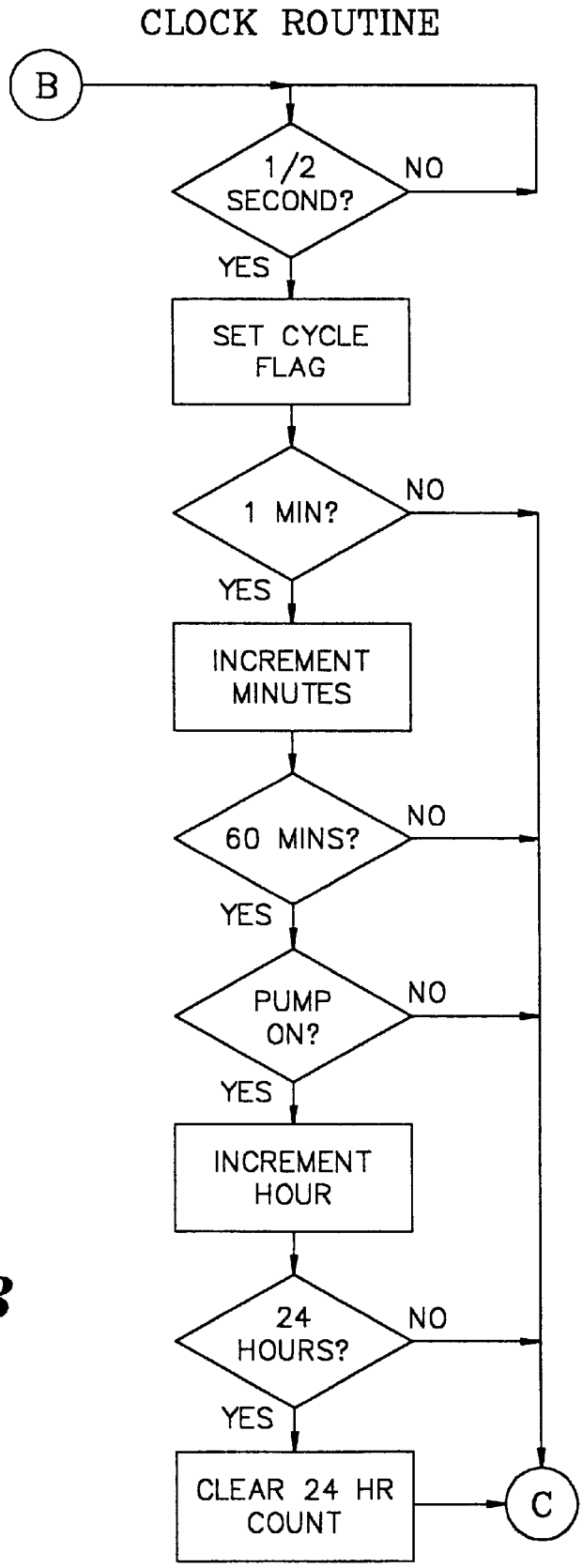
Figure 3C:
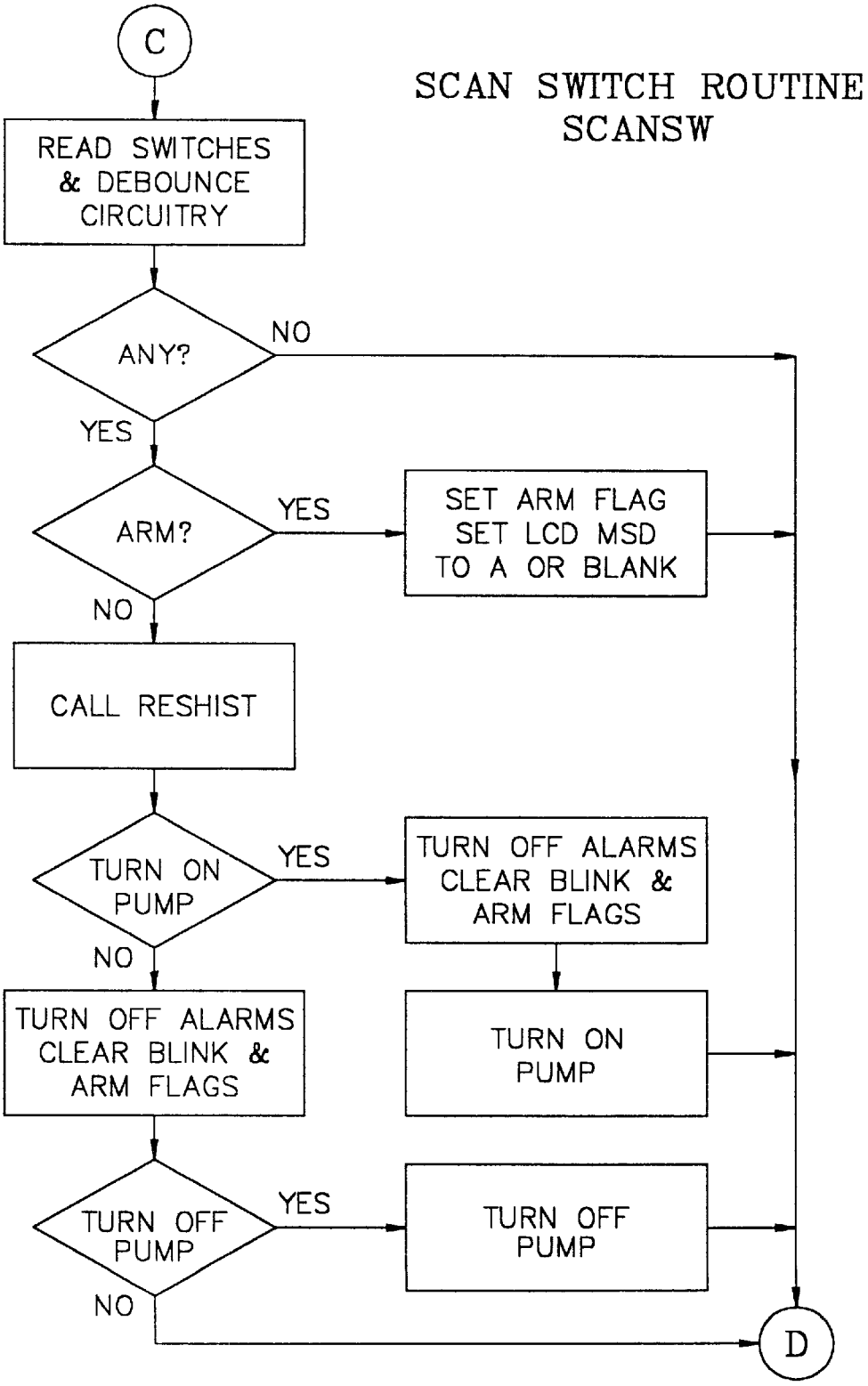
Figure 3D:
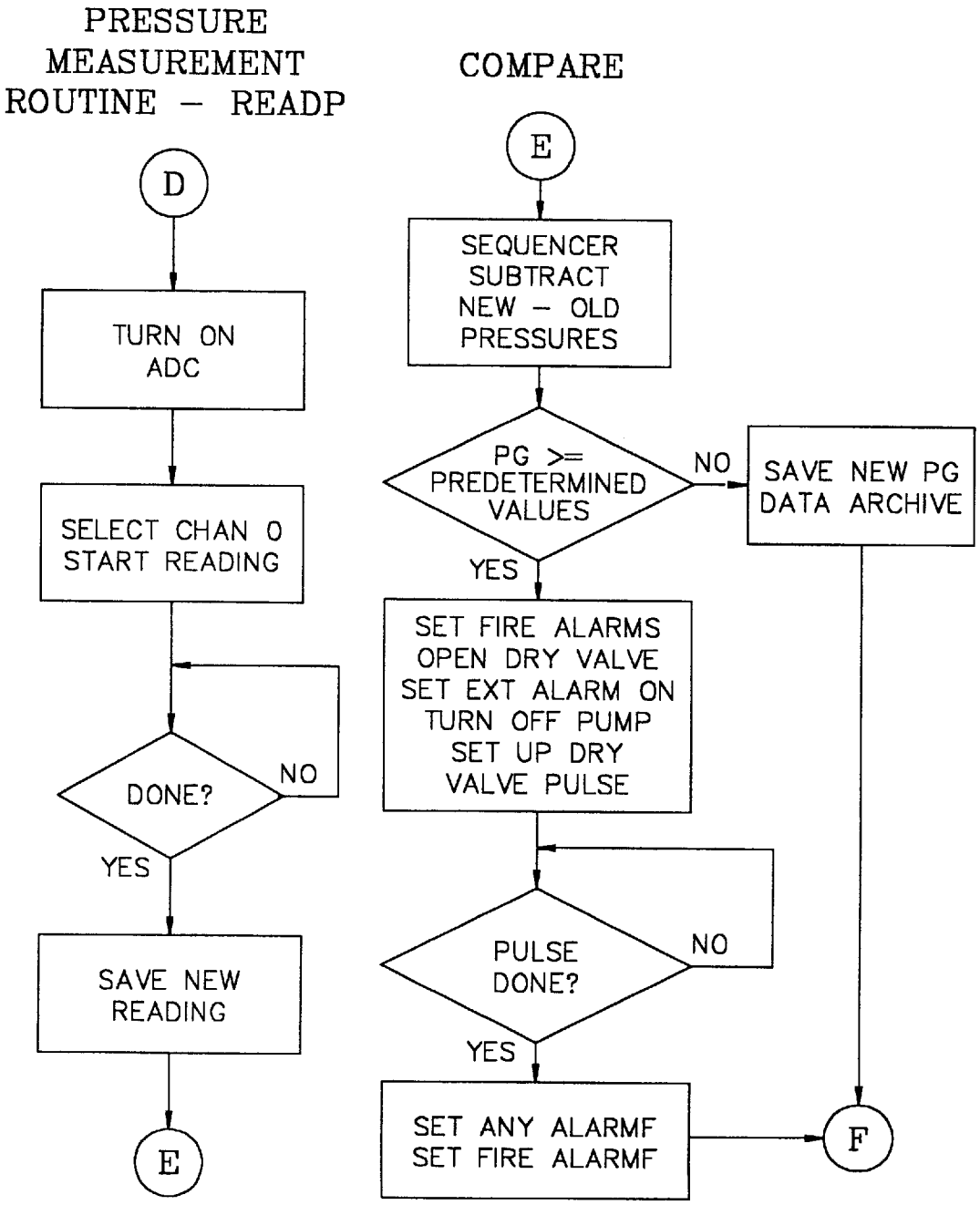
Figure 3E:
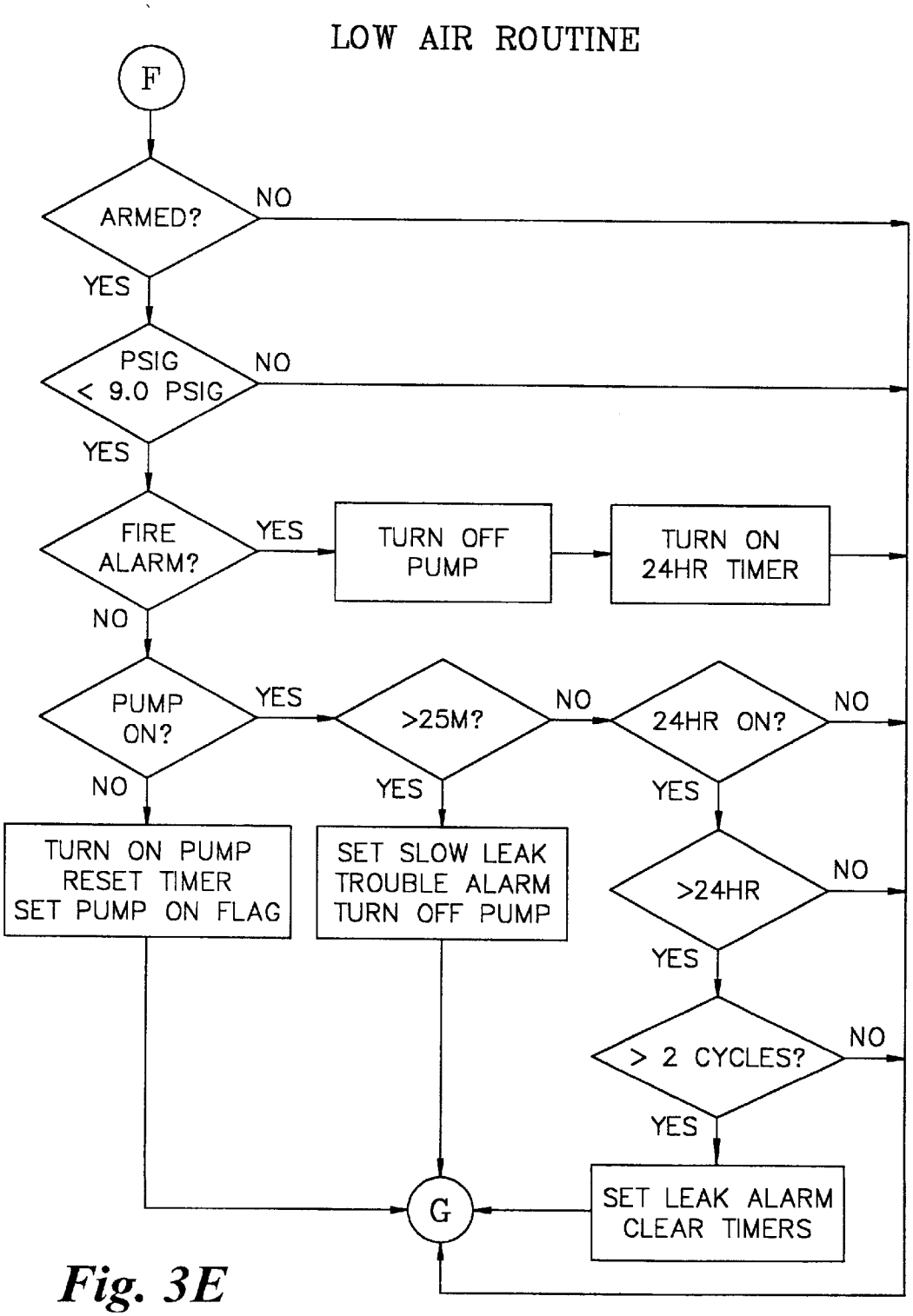
Figure 3F:
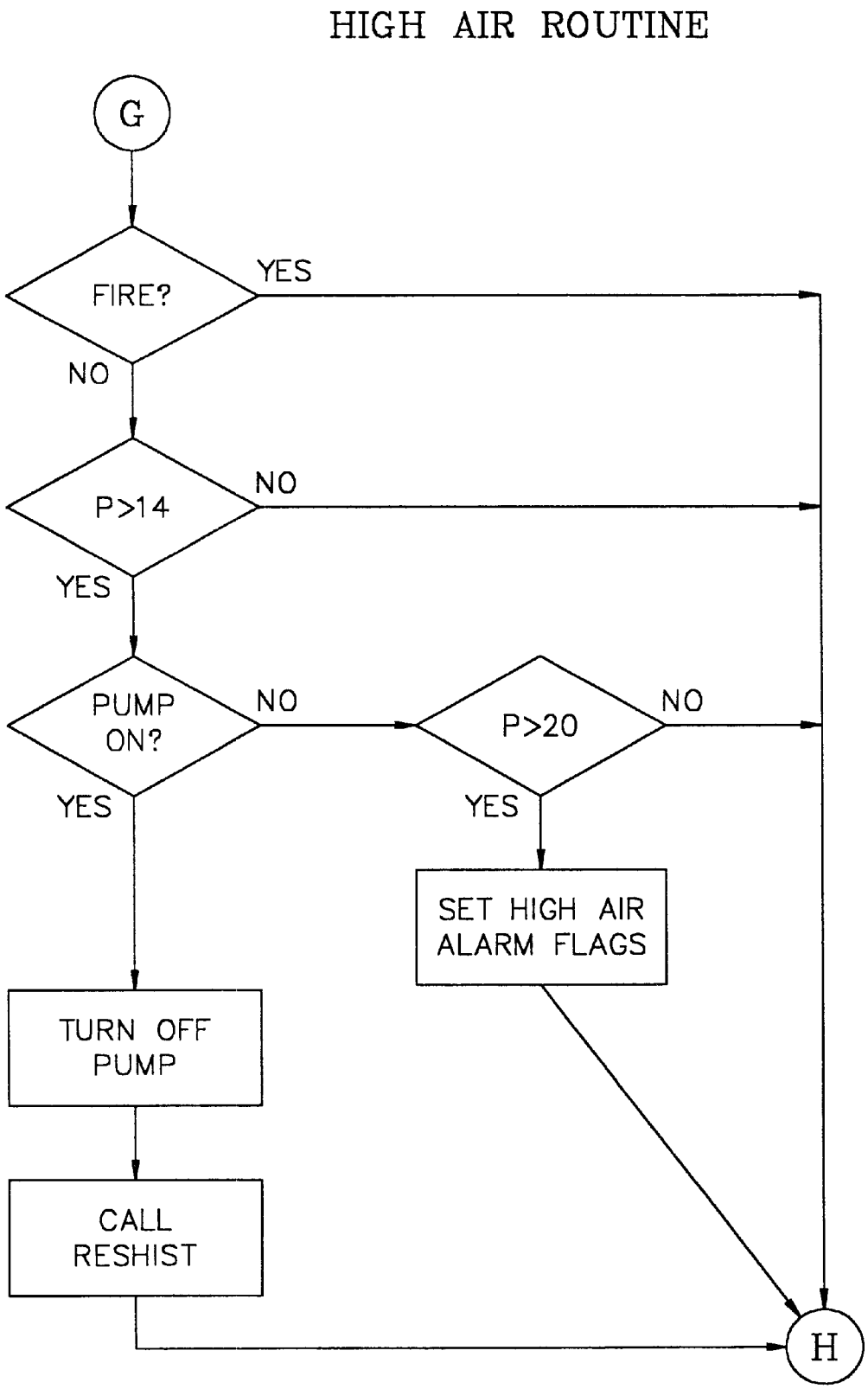
Figure 3G:
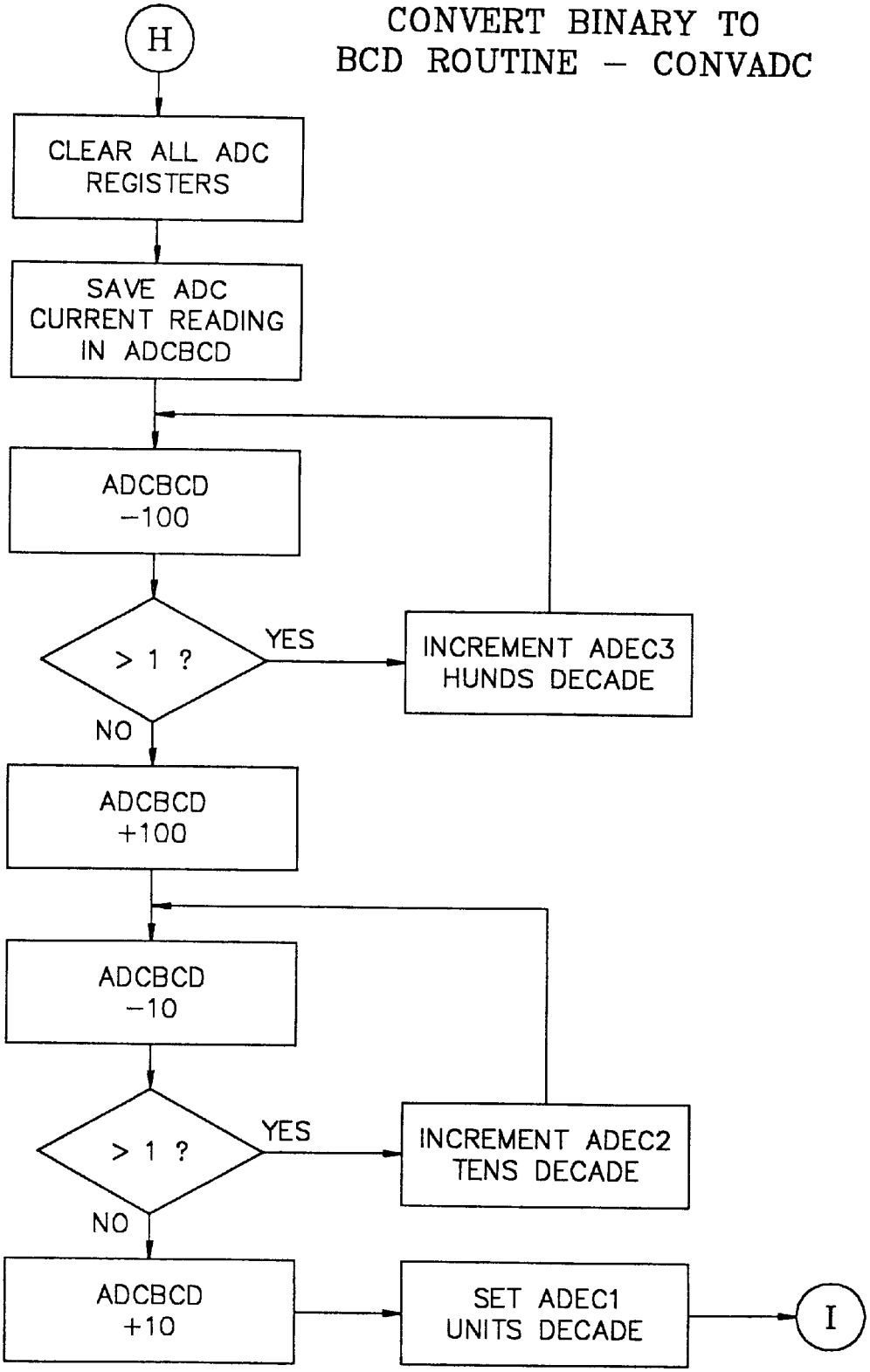
Figure 3H:
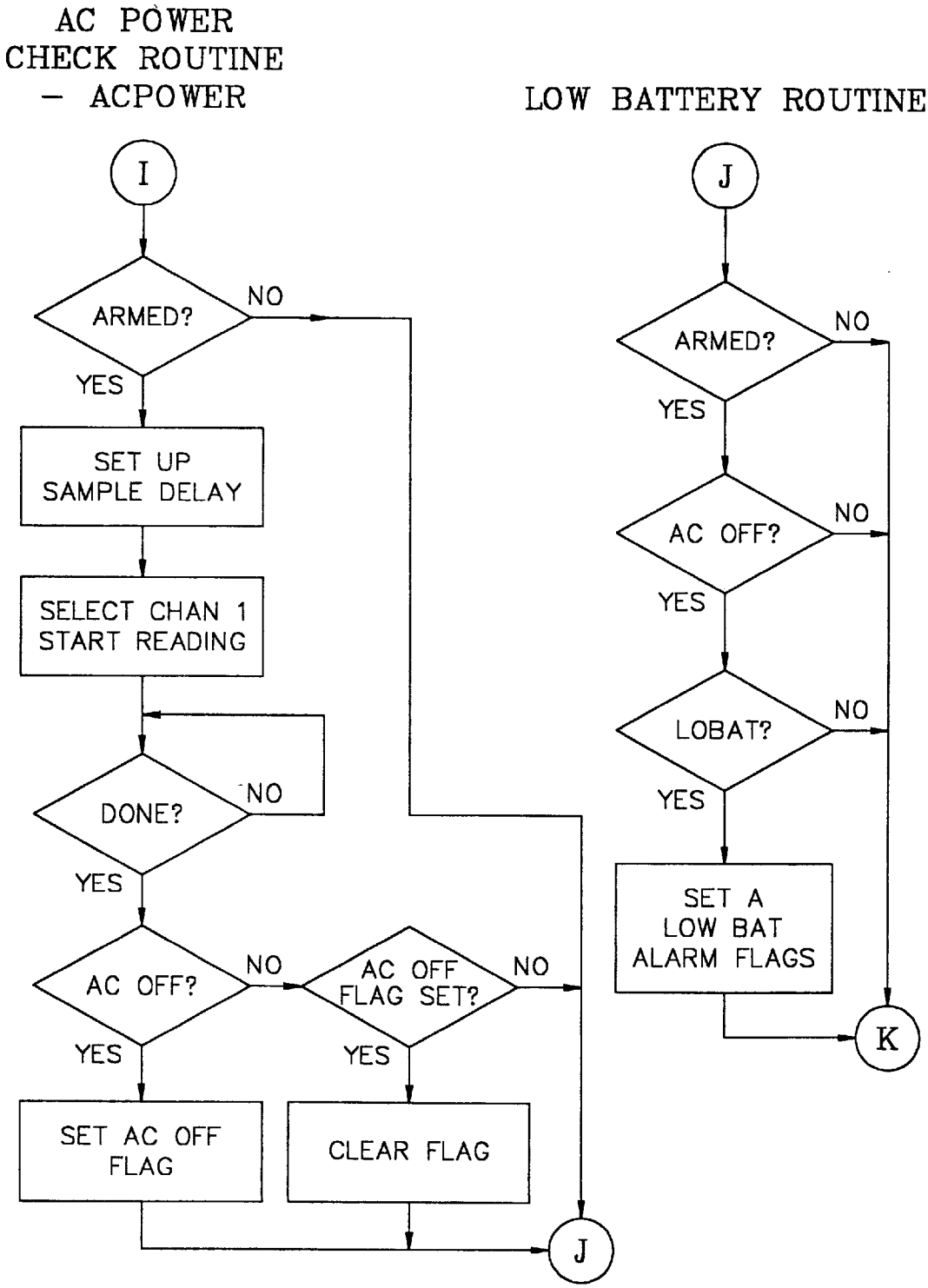
Figure 3I:
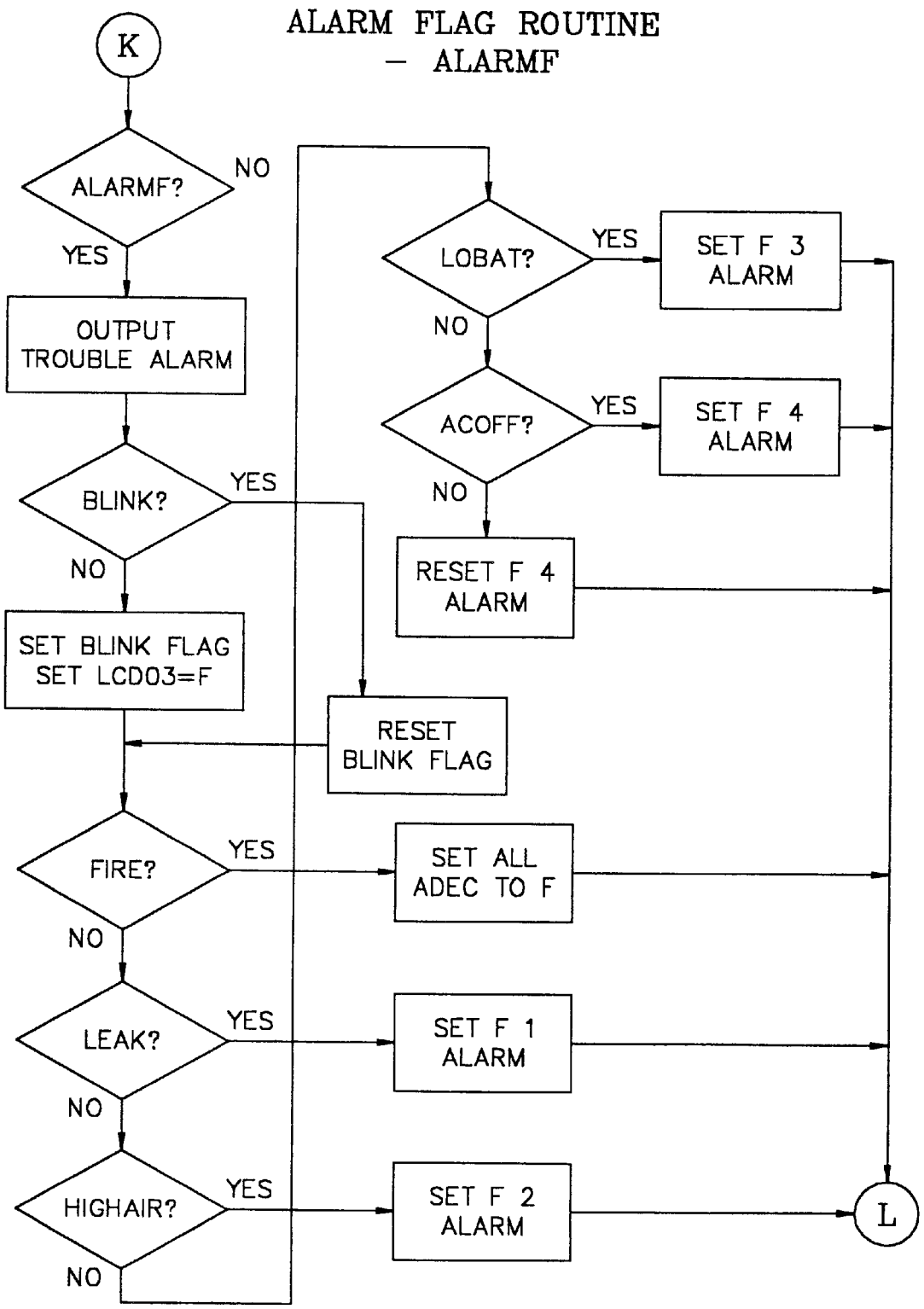
Figure 3J:
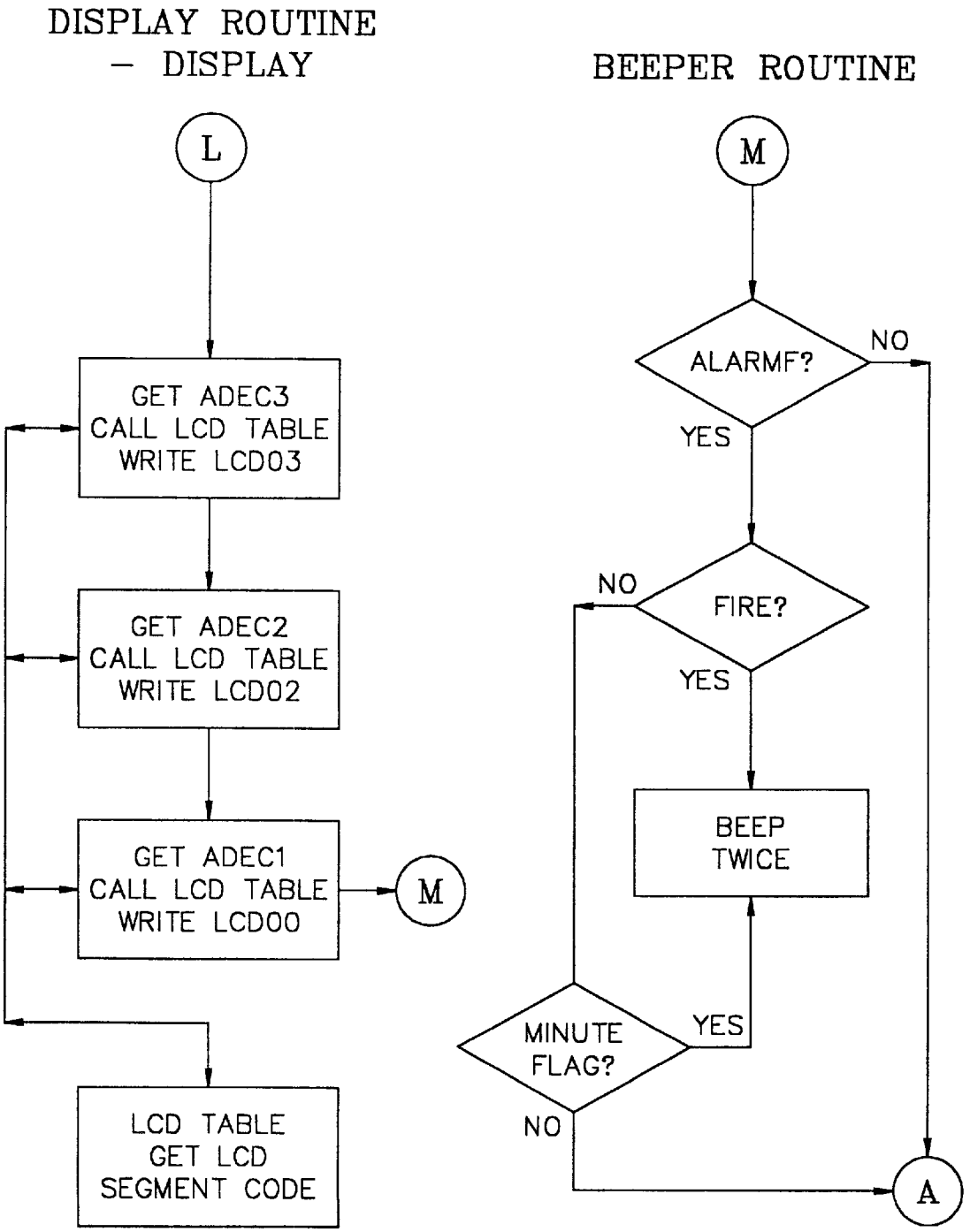

After step 130 is performed, the system performs a variety of routines (step 132) described in FIG. 3A, and set forth in detail in FIGS. 3B–3J.

The system continuously cycles through the steps in FIGS. 2A–2C. Since the steps are being performed continuously, the exact order of the steps in FIGS. 2A–2C are not critical. However, if step 124 is used as the primary indicator of a slow air leak, and not as a redundant check, this step should be removed from the current location and placed outside of the loop comprising steps 110–128 so that the step is performed during each cycle through the flowchart. For example, step 124 may be located immediately before step 110 or step 128. In its current location, step 124 is performed only when the line pressure has already dropped below the preset value and thus in its present position, step 124 cannot provide an early warning of a slow air leak.

FIGS. 3A–3J, taken together, is a detailed flowchart of the steps for performing one preferred embodiment of the present invention. FIGS. 3A–3J also show how a fire alarm is integrated into the system. In the flowchart, a fire alarm indicates that a sprinkler is open. A trouble alarm is used for all other alarm conditions. The embodiment of FIGS. 3A–3J detects slow air leaks by monitoring for conditions (1) and (2) described above, and operates within the parameters set forth below. The steps of the flowchart are otherwise self-explanatory and thus are not described further.

Sample approximate operating parameters for one embodiment of the system 10 are as follows:

| | |
|---|---|
| Controlled Charge Air Pressure: | Min. 7 psig, Max. 15 psig<br>Actual control - 9 to 14 psig |
| System Temperature Range: | 0°–70° C. (32° F.–158° F.) |
| System Maximum Water Pressure: | Working - 175 psig, Test - 200 psig |
| Rate of Pressure drop for determination of open sprinkler head | 0.1 to 0.4 psig/seconds<br>(set in software and software adjustable) |
| Slow Air Leak | Unable to pressurize<br>Condition (1) - Air compressor runs for 25 minutes<br>Condition (2) - Air Compressor cycles more than 2 times in a 24 hour period |
| Time bet. detection of open sprinkler and opening of primary water supply valve 18 | 5 seconds or less |
| Pressure drop to trigger air compressor 38 | 2 psig |
| Water piping: | 1" copper tubing |
| Low Battery Level (for 12 V battery): | Final voltage detect ~ 10.5 V |

The system temperature range of 0 to 70° C. refers to the entire system, including the sprinkler grid 12. The primary water supply value 18 should be located where the water source is not below freezing.

Referring to FIG. 1, the solenoid-driven water supply valve 18 may be replaced with other types of dry valves which include different control mechanisms for opening the valve. For example, a pilot valve or other type of control valve may be used to open the water supply valve 18. The water supply valve 18 may thus be either directly or indirectly controlled. However, a solenoid-driven water supply valve is preferred because it has a quick response time and easily interfaces with electrical control circuitry. Portions of the system 10 may be packaged in modular form. For example, a single system enclosure (shown by dashed lines in FIG. 1) may house the electronic circuitry 42, internal audible alarm 54, small air compressor 38 and battery 64. The enclosure may be a NEMA Type 1 enclosure having physical dimensions of 10"H×8"W×4"D.

While sample operating parameters are disclosed, operating parameters of the system 10 depend upon the particular components used for the fluid flow line 20, sprinkler grid 12 and the like. Likewise, values used for detection of conditions depend upon the operating parameters of the system 10. One significant advantage of the system 10 is that it can accurately detect a pressurized air leak and open sprinkler head condition using a fluid flow line 20 which has a relatively low air pressure charge. As discussed above, the lower pressure reduces the time for water to reach the open sprinkler head because there is less air to expel from the fluid flow line. Another significant advantage of the system 10 is that condition detection time, particularly, open sprinkler head detection time, is reduced significantly from prior art detection times associated with dry pipe systems charged to 60 psig. The present invention is able to detect an open sprinkler head and open the primary water supply valve in a few seconds, instead of up to 30 seconds minute as in prior art systems. The pressure rate detection method used herein is not affected by the capacity of the sprinkler grid 12. Thus, both large and small sprinkler grids 12 may be operated in a low pressure mode. Since charging pressure is reduced from prior art systems, there is less static load on sprinkler components.

Ambient temperature changes which cause expansion and contraction of the pressurized air in the fluid flow lines will not affect the operation of the system. As the ambient temperature drops, dp/dt will be a very small negative value that can be readily discriminated from more negative dp/dt values which indicate either an open sprinkler head or an air pressure leak.

The present invention is particularly suitable for residential sprinkler systems having a dry pipe portion located where the temperature drops below freezing. Wet pipe sprinkler systems are impractical in such environments due to potential damage from freezing pipes. The present invention is equally suited for commercial and industrial dry pipe sprinkler systems, as well as for retrofitting of existing dry pipe sprinkler systems.

The dp/dt value used to detect an open sprinkler condition and the detection time required for ascertaining such a condition both depend upon the grid capacity of the system, the orifice of the sprinkler head, the resolution of the pressure sensor 40 (e.g., 8 bit vs. 12 bit), and the normal charge pressure. The time period required to cause a predetermined pressure drop for a given grid capacity and sprinkler head orifice can be directly calculated based upon the dp/dt values. Tables 1 and 2 below are data generated from a system prototype test having initially charged line pressures in the range of 14 to 15 psig. Data from an actual installation will vary from the prototype values, but should exhibit similar trends and characteristics.

TABLE 1

| 0.375" Orifice | | | |
|---|---|---|---|
| Grid Capacity | Pressure Drop Slope, dp/dt | Min./Max. Detection Time (sec.) | |
| (gallons) | (psig/sec.) | 8 Bit ADC | 12 Bit ADC |
| 25 | 1.54 | 0.5/1 | 0.5/1 |
| 50 | 1.04 | 0.5/1 | 0.5/1 |
| 75 | 0.81 | 0.5/1 | 0.5/1 |
| 100 | 0.56 | 1.5/2 | 0.5/1 |
| 125 | 0.52 | 1.5/2 | 0.5/1 |
| 150 | 0.48 | 1.5/2 | 0.5/1 |
| 200 | 0.42 | 1.5/2 | 0.5/1 |

TABLE 2

| 0.500" Orifice | | | |
|---|---|---|---|
| Grid Capacity | Pressure Drop Slope, | Min./Max. Detection Time (sec.) | |
| (gallons) | dp/dt (psig/sec.) | 8 Bit ADC | 12 Bit ADC |
| 150 | 0.55 | 1.0/1.5 | 0.5/1 |
| 200 | 0.43 | 1.0/1.5 | 0.5/1 |
| 250 | 0.36 | 1.5/2 | 0.5/1 |
| 350 | 0.28 | 1.5/2.0 | 0.5/1 |
| 500 | 0.20 | 2.0/2.5 | 1.0–1.5 |
| 750 | 0.16 | 2.5/3.0 | 2.0–2.5 |
| 1000 | 0.11 | 4.0/4.5 | 2.5–3 |
| 2000 | 0.05 | 8.0/8.5 | 6.0–6.5 |

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A method of operating a dry pipe sprinkler system, the method comprising monitoring the charged fluid flow line by:

(a) sensing pressure in a gas charged fluid flow line of the system and generating a signal representing instantaneous gas pressure in the fluid flow line;

(b) calculating a rate of change of the instantaneous gas pressure;

(c) comparing the rate of change to a predetermined negative rate of change value; and (d) outputting an open sprinkler head signal if the rate of change is more negative than the predetermined negative value, thereby detecting sprinkler openings in the system.

2. A method according to claim 1 further comprising:

(e) comparing the sensed pressure to a preset value which is less than the operating pressure;

(f) recharging the fluid flow line to the operating pressure if the sensed pressure is below the preset value by operating a gas compressor which has its output connected to the fluid flow line; and (g) outputting a pressurized gas leak signal if the fluid flow line pressure is not restored to the operating pressure within a predetermined time period.

3. A method according to claim 1 further comprising:

(e) comparing the sensed pressure to a preset value which is less than the operating pressure;

(f) recharging the fluid flow line to the operating pressure if the sensed pressure is below the preset value by operating a gas compressor which has its output connected to the fluid flow line; and (g) outputting a pressurized gas leak signal if the gas compressor is actuated to restore pressure more than a predetermined number of times in a fixed time period.

4. A method according to claim 1 further comprising:

(e) outputting a pressurized gas leak signal if the rate of change is negative and less negative than the predetermined negative value.

5. A method according to claim 1 further including sending the open sprinkler head signal to a monitoring location remote from the sprinkler system.

6. A method according to claim 1 further including displaying an open sprinkler head warning signal in response to the open sprinkler head signal.

7. A method according to claim 1 further comprising opening a primary fluid flow supply valve for the sprinkler system upon detection of an open sprinkler head signal to allow water or fire retarding liquid to flow through the fluid flow line and open sprinkler heads.

8. A method according to claim 1 further comprising, prior to steps (a) and (b), charging the fluid flow line to a pressure between about 7 psig to about 15 psig.

9. Apparatus including electronic circuitry adapted for use in a dry pipe sprinkler system to monitor a gas charged fluid flow line in the system, the electronic circuitry comprising:

(a) an input for receiving an electrical signal representing the instantaneous gas pressure in the gas charged fluid flow line; and (b) a processor for using the electrical signal to calculate a rate of change of the instantaneous gas pressure and compare the rate of change to a predetermined negative rate of change value, the processor outputting an open sprinkler head signal if the rate of change is more negative than the predetermined negative value.

10. Apparatus according to claim 9 wherein the system has an operating pressure and the processor further uses the electrical signal to determine whether the instantaneous gas pressure is below a preset value which is less than the operating pressure, and if so, outputs a control signal to actuate a gas compressor to restore the fluid flow line gas pressure to the operating pressure, the processor further outputting a pressurized gas leak signal if the fluid flow line pressure is not restored to the operating pressure within a predetermined time period.

11. Apparatus according to claim 9 wherein the system has an operating pressure and the processor further uses the electrical signal to determine whether the instantaneous gas pressure is below a preset value which is less than the operating pressure, and if so, outputs a control signal to actuate a gas compressor to restore the fluid flow line gas pressure to the operating pressure, the processor further monitoring the gas compressor actuations and outputting a pressurized gas leak signal if the gas compressor is actuated to restore pressure more than a predetermined number of times in a fixed time period.

12. Apparatus according to claim 9 wherein the processor further outputs a slow pressure loss signal if the rate of change is negative and less negative than the predetermined negative value.

13. Apparatus according to claim 9 further comprising a communication device connected to the processor for sending the open sprinkler head signal to a monitoring location remote from the sprinkler system.

14. Apparatus according to claim 9 further comprising a display in communication with the processor for displaying an open sprinkler status condition in response to an open sprinkler head signal being output by the processor.

15. Apparatus according to claim 9 further comprising a control mechanism in communication with the processor for opening a primary fluid supply valve for the sprinkler system in response to an open sprinkler head signal output by the processor, thereby allowing fluid flow through the fluid flow line and open sprinkler heads.

16. Apparatus according to claim 15 wherein the control mechanism includes a solenoid valve associated with the primary fluid supply valve.

17. Apparatus according to claim 9 wherein the electronic circuitry further comprises:

(c) a first output connected to the processor for providing a control signal for opening a primary fluid supply valve if the processor outputs an open sprinkler head signal.

18. Apparatus according to claim 9 further comprising a primary fluid supply valve for the sprinkler system in communication with the processor, the primary fluid supply valve adapted to open in response to the outputting of an open sprinkler head signal by the processor, thereby allowing fluid flow through the fluid flow line and open sprinkler heads.

19. Apparatus according to claim 9 further comprising:

a dry pipe sprinkler grid having a plurality of sprinkler heads;

a primary fluid supply valve having a normally wet input side and a normally dry output side;

at least one fluid flow line providing a fluid connection between the dry pipe sprinkler grid and the output side of the primary fluid supply valve, the fluid flow line being normally charged with a pressurized gas; and a pressure transducer connected in fluid communication with a gas charged fluid flow line of the grid, and connected to the input of the electronic circuitry.

20. A method of controlling the state of a primary fluid flow supply valve associated with a dry pipe sprinkler system, the method comprising:

(a) detecting the occurrence of an open sprinkler in the system by monitoring a rate of change of gas pressure versus time in the fluid flow line and determining when the rate of change versus time is more negative than a predetermined negative value; and (b) opening the primary fluid flow supply valve to allow fire retarding fluid to flow through the fluid flow line when the rate of change versus time is determined to be more negative than the predetermined negative value.

21. A method of monitoring a dry pipe sprinkler system to detect pressurized gas leaks in a gas charged fluid flow line in the system, the fluid flow line having an operating pressure, the method comprising the steps of:

(a) sensing pressure in a gas charged fluid flow line of the system;

(b) comparing the sensed pressure to a preset value which is less than the operating pressure;

(c) recharging the fluid flow line to the operating pressure if the sensed pressure is below the preset value by operating a gas compressor which has its output connected to the fluid flow line; and (d) outputting a pressurized gas leak signal if the fluid flow line pressure is not restored to the operating pressure within a predetermined time period.

22. A method of monitoring a dry pipe sprinkler system to detect pressurized gas leaks in a gas charged fluid flow line in the system, the fluid flow line having an operating pressure, the method comprising the steps of:

(a) sensing pressure in a gas charged fluid flow line of the system;

(b) comparing the sensed pressure to a preset value which is less than the operating pressure;

(c) recharging the fluid flow line to the operating pressure if the sensed pressure is below the preset value by operating a gas compressor which has its output connected to the fluid flow line; and (d) outputting a pressurized gas leak signal if the gas compressor is actuated to restore pressure more than a predetermined number of times in a fixed time period.

23. A method of monitoring a dry pipe sprinkler system to detect pressurized gas leaks in a gas charged fluid flow line in the system, the method comprising the steps of:

(a) sensing pressure in a gas charged fluid flow line of the system and generating a signal representing instantaneous gas pressure in the fluid flow line;

(b) calculating a rate of change of the instantaneous gas pressure;

(c) comparing the rate of change to a predetermined negative rate of change value; and (d) outputting a pressurized gas leak signal if the rate of change is negative and less negative than the predetermined negative value.

* * * * *